US006151832A

United States Patent [19]

Opielski et al.

[11] Patent Number: 6,151,832

[45] Date of Patent: Nov. 28, 2000

[54] WINDOW BALANCE CAM HOUSING

[75] Inventors: Brian C. Opielski, Malvern; Jeffrey B. Hersh, Wayne, both of Pa.; Dennis Westphal, Parma, Mich.

[73] Assignee: CertainTeed Corporation, Valley Forge, Pa.

[21] Appl. No.: 09/253,191

[22] Filed: Feb. 19, 1999

Related U.S. Application Data

[63] Continuation of application No. 29/066,199, Feb. 7, 1997, abandoned.

[51] Int. Cl.[7] ..... E05D 15/22

[52] U.S. Cl. ..... 49/181

[58] Field of Search ..... 49/176, 181, 445, 49/446, 447; 16/DIG. 6, DIG. 16

[56] References Cited

U.S. PATENT DOCUMENTS

| | | | |
|---|---|---|---|
| 4,718,194 | 1/1988 | Fitzgibbon et al. | 49/181 |
| 5,210,976 | 5/1993 | Cripps | 49/181 |
| 5,371,971 | 12/1994 | Prete | 49/181 X |

OTHER PUBLICATIONS

CertainTeed Part No. A–187598. On sale prior to Feb. 7, 1996.

*Primary Examiner*—Jerry Redman

*Attorney, Agent, or Firm*—Duane Morris & Heckscher LLP

[57] ABSTRACT

A window balance cam housing has a body generally in the form of a rectangular prism having a generally cylindrical bore therethrough. The body has a bottom side, a top side, a right side, a left side, a near side, and a far side. The generally cylindrical bore extends between the near side and the far side and has a portion of more narrow diameter between the right side and the left side respectively. The top side has a gap defined therein, permitting flexing to change the separation between the right side and the left side. Brake shoes are provided on each of the right side and the left side. A first pair of vertical ridges extends symmetrically outward from the near side and the far side. A second pair of vertical ridges extends symmetrically outward from the near side and the far side, the second pair of vertical ridges being higher than the first pair. There may be a third pair of vertical ridges extending symmetrically outward from the near side and the far side, which third pair has the same height as the first pair.

7 Claims, 1 Drawing Sheet

WINDOW BALANCE CAM HOUSING

RELATED APPLICATIONS

This application is a continuation of design application Ser. No. 29/066,199, filed Feb. 7, 1997, now abandonded, the entire specification of which is considered to be part of the disclosure of this application and is hereby incorporated by reference herein.

FIELD OF THE INVENTION

This invention relates to pivotable sash windows, and in particular to cam housings for use in such windows.

BACKGROUND OF THE INVENTION

Pivotable sash windows are well known. These windows include assemblies to permit pivoting of the windows for cleaning. These assemblies including rotating cams, and cam housings that move vertically. The cam housings are designed to operate as brakes to prevent movement of the sash in the jamb while the sash is pivoted for window cleaning. Cam housings are also referred to as shoes or brakes. Their overall design and operation is well known in the art.

Movement of the cam housing horizontally within the jamb has been identified by the inventors as a drawback of existing sash window designs. This results in difficulty in the smooth operation of the pivoting feature of the sash.

OBJECTS AND ADVANTAGES OF THE INVENTION

It is an object of this invention to provide a balance cam housing having an improved design.

It is an advantage of this invention that such an improved design is provided.

SUMMARY OF THE INVENTION

A window balance cam housing has a body generally in the form of a rectangular prism having a generally cylindrical bore therethrough. The body has a bottom side, a top side, a right side, a left side, a near side, and a far side. The generally cylindrical bore extends between the near side and the far side and has a portion of more narrow diameter between the right side and the left side respectively. The top side has a gap defined therein, permitting flexing to change the separation between the right side and the left side. Brake shoes are provided on each of the right side and the left side. A first pair of vertical ridges extends symmetrically outward from the near side and the far side. A second pair of vertical ridges extends symmetrically outward from the near side and the far side, the second pair of vertical ridges being higher than the first pair. There may be a third pair of vertical ridges extending symmetrically outward from the near side and the far side, which third pair has the same height as the first pair.

DETAILED DESCRIPTION OF A PREFERRED EMBODIMENT

Figure 1:
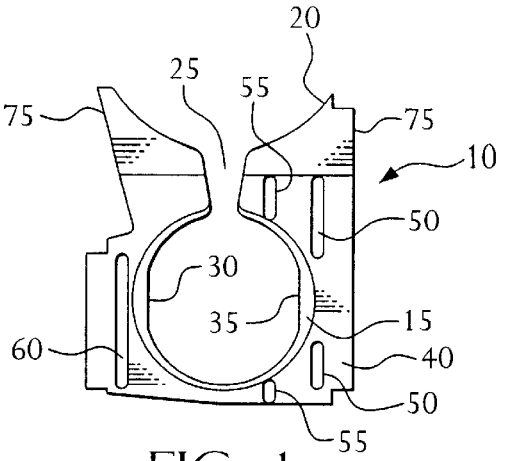
FIG. 1 is a front or near side plan view of an article according to the invention.

Referring to FIG. 1, there is shown a cam housing 10 according to the invention. The overall structure of cam housing 10 is of a solid body, in the form of a rectangular prism, having a central cylindrical bore 15. For convenience of reference, the uppermost side in FIG. 1, which side is depicted in plan in FIG. 6, will be referred to as top side 20. Top side 20 has defined therein a slot or opening 25, which slot extends through top side 20 to bore 15. The interior surface of bore 15 is not completely circular in cross-section. Rather, there are two planar portions 30, 35, which result in reduced diameter in a direction perpendicular to the direction from the center of bore 15 to opening 25 across bore 15 from right to left. As a result, in a well-known manner, an eccentric cam positioned in bore 15, upon rotation and alignment with planar portions 30, 35, will cause the right and left sides of cam housing 10 to be forced away from one another.

Figure 2:
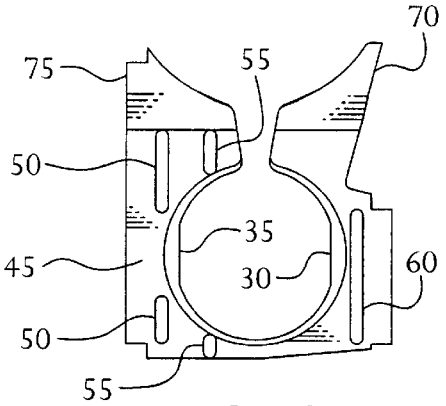
FIG. 2 is a rear or far side plan view of the article of FIG. 1.

Near side 40, shown in plan in FIG. 1, and far side 45, shown in plan in FIG. 2, include planar and symmetrical surfaces surrounding bore 15. On each of near side 40 and far side 45 there are defined first ridge 50, second ridge 55, and third ridge 60. Each ridge is vertical, elongated, linear and protrudes outward from its respective side. Ridges 50, 55, and 60 can be seen in end views in FIGS. 5 and 6. First ridge 50 and second ridge 55 are each interrupted by bore 15. Ridge 60 is continuous. First ridge 50 and third ridge 60 are of the same height. Second ridge 55 is higher than both first ridge 50 and third ridge 60.

Ridges 50, 55 and 60 are advantageous, when matched with suitable corresponding features in a window jamb, in preventing rotation and lateral movement of cam housing 10.

Figure 6:
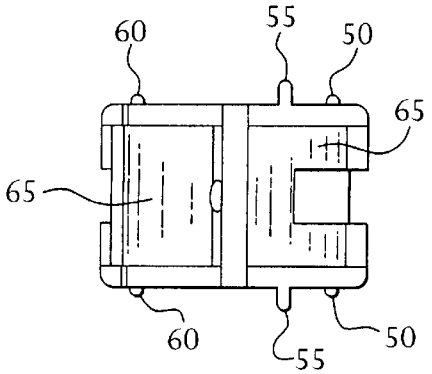
FIG. 6 is a top plan view of the article of FIG. 1.

Referring now to FIGS. 2 and 6, top side 20 includes, as is generally conventional, a partially cylindrical concave surface 65 defined on upstanding members 70, 75. A bore 80 is defined through member 70, as may be seen in FIG. 3.

Figure 5:
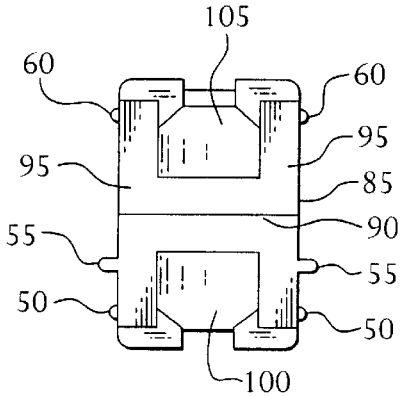
FIG. 5 is a bottom plan view of the article of FIG. 1.

Bottom side 85, as seen in plan in FIG. 5, has major surface 90, which is nearly planar, but is curved convexly with a relatively large radius of curvature. Major surface 90 is continuous with substantially rectangular minor surfaces 95, which are along the near and far side portions of major surface 90 and extending leftward and rightward beyond major surface 90. On the right side and left side of major surface 90, there are generally cylindrical convex left side major surface 105 and right side major surface 100.

Figure 3:
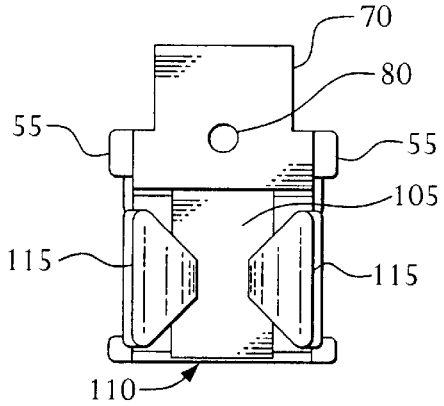
FIG. 3 is a left side plan view of the article of FIG. 1.

On left side 110, as shown in FIG. 3 in plan, there is left side major surface 105. Two generally trapezoidal brake pads 115 define generally planar and trapezoidal brake surfaces. Left side major surface 105 is recessed between brake pads 115.

Figure 4:
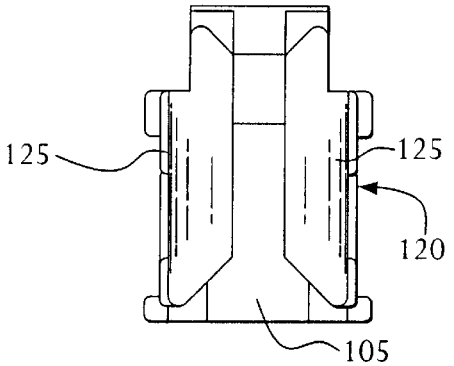
FIG. 4 is a right side plan view of the article of FIG. 1.

On right side 120, shown in plan in FIG. 4, there is generally cylindrical right side major surface 105. Right side major surface 105 is recessed between two generally trapezoidal brake pads 125 defined on near and far sides of right side 120.

As is known in the art, when an eccentric cam contacts surfaces 30 and 35, brake pads 115, 125 are moved outward to exert pressure on the jamb to cause cam housing 10 to be fixed in place. Ridges 50, 55, and 60 reduce any tendency of housing 10 to rotate.

It will be understood that various changes in the details, materials and arrangements of the parts which have been described and illustrated above in order to explain the nature of this invention may be made by those skilled in the art without departing from the principle and scope of the invention as recited in the following claims.

What is claimed is:

1. A window balance cam housing, comprising a body generally in a form of a rectangular prism having a generally cylindrical bore therethrough, said body having a bottom side, a top side, a right side, a left side, a near side, and a far side, said generally cylindrical bore extending between said near side and said far side and having a portion of more narrow diameter between said right side and said left side respectively, said top side having a gap defined therein, permitting flexing to change the separation between said right side and said left side;

brake shoes provided on each of said right side and said left side; and a first pair of vertical ridges extending symmetrically outward from said near side and said far side.

2. The window balance cam housing of claim 1, further comprising a second pair of vertical ridges extending symmetrically outward from said near side and said far side, said second pair of vertical ridges being higher than said first pair.

3. The window balance cam housing of claim 2, further comprising a third pair of vertical ridges extending symmetrically outward from said near side and said far side, said third pair having the same height as said first pair.

4. The window balance cam housing of claim 1, wherein said vertical ridges are interrupted by said bore.

5. The window balance cam housing of claim 1, wherein said bottom side has a major surface being nearly planar with a relatively large radius of curvature, and two substantially rectangular minor surface portions along near and far side portions of said bottom side major surface and extending to said left side and said right side beyond said major surface.

6. The window balance cam housing of claim 5, wherein said right side has a generally cylindrical major surface, which right side major surface extends continuously from said bottom side major surface, and said brake shoes on said right side form two generally trapezoidal planar minor surfaces, said right side major surface being recessed intermediate said two right side minor surfaces.

7. The window balance cam housing of claim 5, wherein said left side has a cylindrical major surface extending continuously from said bottom side major surface, and said brake shoes on said left side form two generally trapezoidal planar minor surfaces defined on near and far sides of said left side, said left side major surface being recessed intermediate said two left side minor surfaces.

* * * * *